US005160242A

United States Patent [19]

Brown

[11] Patent Number: 5,160,242

[45] Date of Patent: Nov. 3, 1992

[54] FREESTANDING MIXED TUNED STEAM TURBINE BLADE

[75] Inventor: Wilmott G. Brown, Winter Park, Fla.

[73] Assignee: Westinghouse Electric Corp., Pittsburgh, Pa.

[21] Appl. No.: 708,655

[22] Filed: May 31, 1991

[51] Int. Cl.[5] ..... B63H 1/16

[52] U.S. Cl. ..... 416/193 A; 416/219 R; 416/223 A; 416/248; 416/500; 416/203

[58] Field of Search ..... 416/193 A, 219 R, 223 A, 416/248, 192, 500, 203

[56] References Cited

U.S. PATENT DOCUMENTS

| | | | |
|---|---|---|---|
| 2,807,435 | 9/1957 | Howlett et al. | 416/248 |
| 3,986,793 | 10/1976 | Warner et al. | 416/193 A |
| 4,878,810 | 11/1989 | Evans | 416/500 |
| 4,919,593 | 4/1990 | Brown | 416/500 |
| 5,017,091 | 5/1991 | Tran | 416/193 A |
| 5,088,894 | 2/1992 | Patel | 416/248 |

FOREIGN PATENT DOCUMENTS 2100809 1/1983 United Kingdom ..... 416/219 R

*Primary Examiner*—Thomas E. Denion

[57] ABSTRACT

A freestanding mixed tuned taper-twisted steam turbine blade having an X-X axis parallel to a rotor axis, includes a root portion having a root center line defined by a root center line radius, a platform portion connected to the root portion; and an airfoil portion connected to the platform portion and having a leading edge, a trailing edge, a convex section-side surface, a concave pressure-side surface and a profiled tip, the platform portion having a concave edge, a convex edge, a first end in vertical proximity to the leading edge of the airfoil portion and a second end in vertical proximity to the trailing edge of the airfoil portion, the concave edge being sloped towards the root center line radius at a predetermined angle of slope to define an arcuate sloped surface, and having a sloped flat cut-out surface formed at the second end of the platform portion, the flat cut-out surface having the same predetermined angle of slope as the concave edge and sloping towards the X-X axis.

17 Claims, 9 Drawing Sheets

FREESTANDING MIXED TUNED STEAM TURBINE BLADE

BACKGROUND OF THE INVENTION

1. Field of the Invention

The present invention relates generally to steam turbine blades and, more specifically, to a freestanding mixed tuned blade designed as a retrofit into an existing turbine rotor.

2. Description of the Related Art

Steam turbines include several rows of rotating and staitonary blades. The stationary blades are mounted on the stationary cylinder which surrounds the turbine rotor, whereas rotating blades are mounted in rows on the rotor and thus rotate with the rotor.

The blades of any given row are usually ientical. Most blades include a root portion which is used to mount the blade in its corresponding mounting structure. a platform portion, and an airfoil portion.

One known type of root portion is designed to be fitted into a side-entry groove of the rotor. The overall configuration of the groove is arcuately shaped and thus the root portion for a side-entry blade is also generally arcuately shaped. Within the category of side-entry blades, one type of root configuration is known as the "fir tree", due to the fact that the shape of the root portion is somewhat like an inverted fir tree. In this type of root portion, there are a series of alternating necks and lugs which interfit with correspondign necks and lugs provided in the rotor groove.

The design of a root portion is an exacting science, one in which slight changes in the configuration of a neck or lug can result in substantial changes in the stress distribution imposed on the entire root portion.

The design of the airfoil portion of the blade is also extremely difficult. The airfoil portions of most steam turbine rotor blades include a leading edge, a trailing edge, a concave pressure-side surface, a convex suction-side surface, and a tip at the distal end opposite the root portion. The airfoil portion shape common to a particularly row of rotor blades differs from the airfoil portion shaped for every other row within a particular turbine. Likewise, no two turbines of different designs share airfoil portions of the same shape. The structural differences in airfoil portion shape result in significant variations in aerodynamic characteristics, stress patterns, operating temperature, and natural frequency of the airfoil portion.

Development of a turbine airfoil portion or "airfoil" for a new commercial, power generation steam turbine may require several years to complete. When designing rotating blades for a new steam turbine, a profile developer is given a certain flow field with which to work. The flow field is determiend by the inlet and outlet angles (for steam passing between adjacent rotating blades of a row), gauging, and the velocity ratio, among other things. "Gauging"]is the ratio of throat to pitch; "throat" is the straight line distance between the trailing edge of one rotor blade and the vacuum-side surface of an adjacent blade, and "pitch" is the distance between the trailing edges of adjacent rotating blade.s Flow fiel parameters are dependent on a number of factors, including the length of the rotor blades of a particular row. The length of the blade is established early in the design stages of the steam turbine and is essentially a function of the overall designed power output of the steam turbine and the power output for that particular stage or row of blades.

Another important aspect of rotating blade design is the tuning of the blades so that throughout the harmonics of running speed destructive resonant frequencies are avoided. Thus, in the process of designing and fabricating turbine rotating blades, it is critically important to tune the resonant frequencies of the blades to minimize forced or resonant vibration. The "harmonics of running speed" is best explained by example. In a typical fossil fuel powered steam turbine, the rotor rotates at 3600 revoluations per minute (rpm) or 60 cycles per second (cps). Since one cps equals one hertz (Hz), and since simple harmonic motino can be described in terms of the angular frequency of circular motion, the running speed of 60 cps produces a first harmonic of 60 Hz, a second harmonic of 120 Hz, a third harmonic of 180 Hz, a fourth harmonic of 240 Hz, etc. Blade designers typically consider frequencies up to the seventh harmonic (420 Hz). The harmonic series of frequencies occurring at intervals of 60 Hz represent the characteristic frequencies of the normal modes of vibration of an exciting force acting upon the rotating blades. If the natural frequencies of oscillation of the rotating blades coincide with the frequencies of the harmonic series, or harmonics of running speed, a destructive resonance can result in one or more of the harmonic frequencies.

Given that exciting forces can occur at a series of frequencies, a blade designer must ensure that the natural resonant frequencies of the blade do not fall on or near any of the frequencies of the harmonic series. This would be an easier task if rotating blades were susceptible to vibration in only one direction. However, a rotating blade is susceptible to vibration in potentially an infinite number of directions. Each direction of vibration will have a different corresponding natural resonant frequency. The multi-directional nature of blade vibration is referred to as the "modes of vibration". For a row of lashed rotating blades, up to at least seven different modes or directions of vibration are considered by blade designers. Each mode of vibration establishes a different natural resonant frequencies for a given rotating blade for ag iven direction.

The first mode of vibration is a tangential vibration in the rotational direction of the rotor, and is substantially influenced by the positon of the lower of two lashing wires used to interconnect groups of rotating blades. Lowering the position of the lower lashing wire tends to increase the resonant frequency for the first mode of vibration. The second mode of vibration is a tangential vibration in the axial direction of the rotor. The position of the lower lashing wire tends to have an inverse effect on the second mode frequency such that, as the lower wire is lowered to raise the frequency in the first mode, the frequency of the second mode falls. The third mode of vibration is vibration in the "X" direction such that displacement occurs in the axial direction of a wired group of blades. The third mode of vibration is highly dependent on the number of blades per group; the frequency is lowered with the addition of more blades in the grup. The fourth mode of vibration is an in-phase vibration which is highly dependent on the position of the outer-most lashing wire. Moving the outermost lashing wire downwardly lowers the frequency in the fourth mode.

For freestanding blades, the mode shape of the first two modes is the same. However, the mode shape of the third or fourth mode, while not being an "X" shape is a torsional shape instead.

Modes of vibration beyond the third or fourth mode become increasingly complex. These modes are of different mode shapes depending on many factors, too numerous to detail here.

When turning lashed rotating blades, it is important to tune the blades with respect to the first three modes of vibration. Keeping in mind the harmonic series described above for a fossil fuel power steam turbine operating at 3600 rpm, the natural resonant frequency for a rotating blade must be tuned to avoid frequencies at intervals of 60 Hz. For example, the second harmonic occurs at 120 Hz and the third harmonic occurs at 180 Hz. The standard practice is to attempt to tune the blade having a frequency falling somewhere between 120 and 180 Hz become as close as possible to the midpoint between the two harmonics, i.e., 150 Hz. It is not unusual to have a rotating blade having a natural resonant frequency which falls between the second and third harmonics for the first mode of vibration. Therefore, it is desirable to tune the blade to have a frequency at or near 150 Hz for the first mode of vibration.

Frequencies for the second and third modes of vibration are similarly tuned to be as close as possible to a midpoint between two successive harmonics. However, frequency tests are commonly run up to and beyond the seventh mode of vibration. With respect to the fourth mode of vibration, a frequency near the seventh harmonic (420 Hz) might be expected. Therefore, the outermost lashing wire should be positioned to make sure that the resonant frequency for the fourth mode of vibration is sufficiently above the seventh harmonic.

When a new steam turbine is designed, the blade designer must tune the turbine blades so that none of the resonant frequencies for any of the modes of vibration coincide with the frequencies associated with the harmonics of running speed. Sometimes, tuning requires a trade-off with turbine performance or efficiency. For example, certain design changes may have to be made to the blade to achieve a desired resonant frequency in a particular mode. This may necessitate an undesirable change elsewhere in the turbine such as a change in the velocity ratio or a change in the pitch or width of the airfoil.

Furthermore, the blade designer must avoid non-synchronous vibration, also labelled "aeroelastic instability", which includes unstalled flutter, stalled flutter, and buffeting. This phenomenon is much more prevalent in freestanding blades. To alleviate aeroelastic instability in freestanding blades, the designer mix tunes the row of blades so that the first mode of adjacent blades vibrates at slightly different frequencies.

A difficult problem arises in the situation where a pre-existing turbine is upgraded to increase its power output. This may be done by increasing the length of the blades of one or more rows, and boring out the cylinder around the row to accommodate the greater overall length. Changes to the side entry grooves provided on the rotor are nearly impossible to make, so that retrofitted blades are usually confined to employ the same root portion as its predecessor blade.

The re-design of the airfoil follows a similar process as that of the design of a new blade. Given the length of the blade and the flow field parameters, the blade designer proceeds to generate a plurality of basic blade sections. An example of a prior art blade is illustrated in FIGS. 1 through 4. Referring to FIG. 1, the basic sections are A—A through G—G. These sections compose six blade developments, the first development being from sectino A—A to B—B, the second development being from B—B to C—C, the third development being from C—C to D—D, etc. The airfoil sections of the blade are composed of the basic transverse sections through the airfoil. Each section is defined by a series of numbered coordinate points connected by a smooth continuous curve generated by spline interpolation. These coordinate points are defined according to the X—X and Y—Y axes which are illustrated in FIGS. 3 and 4. FIG. 4 shows a typical section, which happens to be the F—F section. Also, the root portion is transposed under the section to show the relationship of the root portion to the blade section. The surface between each transverse section is a ruled surface generated by a series of straight lines connecting like numbered coordinate points at each section. For example, FIG. 5 shows the tenon section (the tenon is that part of the blade which is used to attach a shroud which is used to interconnect adjacent blades in a group. The tenon section is not one of the basic sections, but is illustrated herein to show how blade design occurs. IN the attached Table I, the blade section dimensions are specified for the blade section dimensions relative to the points illustrated in FIG. 5. For example, point 1 in FIG. 5 for the tenon section si−0.320inc. (8.128 mm) in the horizontal direction (in the X direction) and −0.973 in. (24.714 mm) in the vertical direction (in the Y direction). Thus, the coordinate points for point 1 in the tenon is −0.320, −0.2973 in. (8.128, 7.551 mm).

TABLE I

| | BLADE SECTION DIMENSIONS (inches) | | | | | | | | | | | |
|---|---|---|---|---|---|---|---|---|---|---|---|---|
| SECTION | 1 | 2 | 3 | 4 | 5 | 6 | 7 | 8 | 9 | 10 | 10A | 11 |
| A-A | −.450 | −.353 | −.257 | −.160 | −.063 | +.034 | +.130 | +.227 | +.324 | +.420 | +.475 | +.517 |
| B-B | −.450 | −.340 | −.250 | −.150 | −.050 | +.049 | +.152 | +.254 | +.354 | +.452 | +.500 | +.553 |
| C-C | −.129 | −.656 | −.483 | −.310 | −.137 | +.035 | +.208 | +.380 | +.553 | +.726 | +.815 | +.898 |
| D-D | −1.253 | −1.000 | −.746 | −.493 | −.289 | +.015 | +.268 | +.522 | +.775 | +1.029 | +1.158 | +1.282 |
| E-E | −1.676 | −1.342 | −1.008 | −.673 | −.339 | −.005 | +.329 | +.663 | +1.157 | +1.332 | +1.516 | +1.666 |
| F-F | −1.976 | −1.584 | −1.193 | −.801 | −.410 | −.018 | +.374 | +.765 | +.457 | +1.548 | +1.757 | +1.940 |
| G-G | −2.100 | −1.685 | −1.270 | −.855 | −.440 | −.025 | +.390 | +.305 | +1.220 | +1.635 | +1.855 | +2.050 |
| Tenon | −.320 | −.250 | −.180 | −.110 | −.040 | +.030 | +.100 | +.170 | +.240 | +.310 | — | +.310 |
| A-A | −1.954 | −1.137 | −.514 | +.023 | +.424 | +.712 | +.922 | +1.128 | +1.308 | +1.470 | +1.558 | +1.612 |
| B-B | −1.953 | −1.205 | −.667 | −.155 | +.265 | +.605 | +.870 | +1.008 | +1.280 | +1.455 | +1.540 | +1.625 |
| C-C | −2.111 | −1.370 | −.683 | −.086 | +.348 | +.628 | +.829 | +.985 | +1.115 | +1.230 | +1.283 | +1.335 |
| D-D | −2.171 | −1.382 | −.676 | +.190 | +.300 | +.598 | +.794 | +.910 | +.947 | +.916 | +.873 | +.828 |
| E-E | −2.108 | −1.292 | −.333 | +.031 | +.400 | +.641 | +.752 | +.744 | +.635 | +.439 | +.296 | +.173 |
| F-F | −1.953 | −1.081 | −.333 | +.164 | +.489 | +.679 | +.717 | +.625 | +.413 | +.092 | −.125 | −.326 |
| G-G | −1.832 | −.930 | −.960 | +.321 | +.592 | +.714 | +.699 | +.548 | +.276 | −.106 | −.350 | −.587 |
| Tenon | −.973 | −.522 | −.131 | +.210 | +.480 | +.684 | +.844 | +.978 | +1.101 | +1.213 | — | +1.315 |
| SECTION | 12 | 13 | 14 | 15 | 16 | 17 | 18 | 19 | 20 | 21 | 21A | 22 | 23 |

TABLE I-continued

| | | | | | | | | | | | | | |
|---|---|---|---|---|---|---|---|---|---|---|---|---|---|
| A-A | −.450 | −.353 | −.257 | −.160 | −.063 | +.034 | +.130 | +.227 | +.324 | +.420 | +.476 | +.517 | — |
| B-B | −.450 | −.340 | −.250 | −.150 | −.050 | +.049 | +.152 | +.254 | +.354 | +.452 | +.500 | +.553 | — |
| C-C | −.829 | −.656 | −.483 | −.310 | −.137 | +.035 | +.208 | +.380 | +.553 | +.726 | +.815 | +.898 | — |
| D-D | −1.253 | −1.000 | −.746 | −.493 | −.239 | +.015 | +.268 | +.522 | +.775 | +1.029 | +1.158 | +1.282 | — |
| E-E | −1.676 | −1.342 | −1.008 | −.673 | −.339 | −.005 | +.329 | +.663 | +.998 | +1.332 | +1.516 | +1.666 | — |
| F-F | −1.976 | −1.584 | −1.193 | −.801 | −.410 | −.018 | +.374 | +.765 | +1.157 | +1.548 | +1.757 | +1.940 | — |
| G-G | −2.100 | −1.685 | −1.270 | −.855 | −.440 | −.025 | +.390 | +.805 | +1.220 | +1.548 | +1.855 | +2.050 | — |
| Tenon | −.320 | −.250 | −.180 | −.110 | −.040 | +.030 | +.100 | +.170 | +.240 | +.310 | — | +.380 | — |
| A-A | −2.105 | −1.774 | −1.442 | −1.111 | −.780 | −.448 | −.117 | +.215 | +.546 | +.877 | +1.109 | +1.342 | −1.975 |
| B-B | −2.113 | −1.675 | −1.308 | −.903 | −.512 | −.131 | +.225 | +.543 | +.825 | +1.078 | +1.200 | +1.323 | −1.974 |
| C-C | −2.213 | −1.705 | −1.164 | −.700 | −.304 | +.035 | +.335 | +.582 | +.796 | +.993 | +1.083 | +1.172 | −2.130 |
| D-D | −2.278 | −1.606 | −1.136 | −.678 | −.277 | +.016 | +.251 | +.428 | +.556 | +.650 | +.686 | +.721 | −2.195 |
| E-E | −2.199 | −1.550 | −1.007 | −.567 | −.231 | +.005 | +.151 | +.215 | +.210 | +.144 | +.087 | +.031 | −2.132 |
| F-F | −2.040 | −1.347 | −.814 | −.425 | −.163 | −.013 | +.043 | +.018 | −.082 | −.254 | −.373 | −.492 | −1.978 |
| G-G | −1.919 | −1.217 | −.676 | −.326 | −.121 | −.032 | −.032 | −.111 | −.262 | −.480 | −.619 | −.758 | −1.858 |
| Tenon | −1.622 | −1.384 | −1.145 | −.907 | −.668 | −.430 | −.191 | +.048 | +.286 | +.525 | — | +.763 | — |

BLADE SECTION DIMENSIONS (millimeters)

| SECTION | 1 | 2 | 3 | 4 | 5 | 6 | 7 | 8 | 9 | 10 |
|---|---|---|---|---|---|---|---|---|---|---|
| A-A | −11.43 | −8.966 | −6.528 | −4.064 | −1.600 | +0.864 | +3.302 | +5.766 | +8.230 | +10.668 |
| B-B | −11.43 | −8.636 | −6.35 | −3.81 | −1.27 | +1.245 | +3.861 | +6.452 | +8.992 | +11.481 |
| C-C | −3.277 | −16.662 | −12.268 | −7.874 | −3.480 | +0.889 | +5.283 | +9.652 | +14.046 | +18.440 |
| D-D | −31.826 | −25.4 | −18.948 | −12.522 | −7.341 | +0.381 | +6.807 | +13.259 | +19.685 | +26.137 |
| E-E | −42.570 | −34.087 | −25.603 | −17.094 | −8.611 | −0.127 | +8.357 | +16.840 | +29.388 | +33.833 |
| F-F | −50.190 | −40.234 | −30.302 | −20.345 | −10.414 | −0.457 | +9.500 | +19.431 | +11.608 | +39.319 |
| G-G | −53.34 | −42.805 | −32.258 | −21.717 | −11.176 | −0.635 | +9.906 | +7.74 | +30.988 | +41.529 |
| Tenon | −8.128 | −6.35 | −4.572 | −2.794 | −1.016 | +0.762 | +2.54 | +4.318 | +6.096 | +7.874 |
| A-A | −49.632 | −28.880 | −13.056 | +0.584 | +10.770 | +18.085 | +23.419 | +28.651 | +33.223 | +37.338 |
| B-B | −49.606 | −30.61 | −16.942 | −3.937 | +6.731 | +15.367 | +22.098 | +25.603 | +32.512 | +36.957 |
| C-C | −53.619 | −34.80 | −17.348 | −2.184 | +8.839 | +15.951 | +21.057 | +25.019 | +28.321 | +31.242 |
| D-D | −55.143 | −35.103 | −17.170 | +4.826 | +7.62 | +15.189 | +20.168 | +23.114 | +24.054 | +23.266 |
| E-E | −53.543 | −32.817 | −8.458 | +0.787 | +10.16 | +16.281 | +19.101 | +18.898 | +16.129 | +11.151 |
| F-F | −49.606 | −27.457 | −8.458 | +4.166 | +12.421 | +17.247 | +18.212 | +15.875 | +10.490 | +2.337 |
| G-G | −46.533 | −23.622 | −24.384 | +8.153 | +15.037 | +18.136 | +17.755 | +13.919 | +7.010 | −2.692 |
| Tenon | −24.714 | −13.259 | −3.327 | +5.334 | +12.192 | +17.374 | +21.438 | +24.841 | +27.965 | +30.810 |

| SECTION | 10A | 11 | 12 | 13 | 14 | 15 | 16 | 17 | 18 | 19 |
|---|---|---|---|---|---|---|---|---|---|---|
| A-A | +12.065 | +13.1318 | −11.43 | −8.966 | −6.528 | −4.064 | −1.600 | +0.864 | +3.302 | +5.766 |
| B-B | +12.7 | +14.046 | −11.43 | −8.636 | −6.35 | −3.81 | −1.27 | +1.245 | +3.861 | +6.452 |
| C-C | +20.701 | +22.352 | −21.057 | +16.662 | −12.268 | −7.874 | −3.480 | +0.889 | +5.283 | +9.652 |
| D-D | +29.413 | +32.563 | −31.826 | −25.4 | −18.948 | −12.522 | −6.071 | +0.381 | +6.807 | +13.259 |
| E-E | +38.506 | +42.316 | −42.570 | −34.087 | −25.603 | −17.094 | −8.611 | −0.127 | +8.357 | +16.840 |
| F-F | +44.628 | +49.276 | −50.190 | −40.234 | −30.302 | −20.345 | −10.414 | −0.457 | +9.500 | +19.431 |
| G-G | +47.117 | +52.07 | −53.34 | −42.799 | −32.258 | −21.717 | −11.176 | −0.635 | +9.906 | +20.447 |
| Tenon | — | +7.874 | +8.128 | −6.35 | −4.572 | −2.794 | −1.016 | +0.762 | +2.54 | +4.318 |
| A-A | +39.573 | +40.945 | −53.462 | −45.060 | −36.627 | −28.219 | −19.812 | −11.379 | −2.972 | +5.461 |
| B-B | +39.116 | +41.275 | −53.670 | −42.545 | −33.223 | −22.936 | −13.005 | −3.327 | +5.715 | +13.792 |
| C-C | +32.588 | +33.909 | −56.210 | −43.307 | −29.566 | −17.78 | −7.722 | +0.889 | +8.509 | +14.783 |
| D-D | +22.174 | +21.031 | −57.861 | −40.792 | −28.854 | −17.221 | −7.036 | +0.406 | +6.375 | +10.871 |
| E-E | +7.518 | −4.394 | +55.855 | −39.37 | −25.578 | −14.402 | −5.867 | +0.127 | +3.835 | +5.461 |
| F-F | −3.175 | −8.280 | −51.816 | −34.214 | −20.676 | −10.795 | −4.140 | −0.330 | +1.092 | +0.457 |
| G-G | −8.89 | +14.910 | −48.743 | −30.919 | −17.170 | −8.280 | −3.073 | −0.813 | −0.813 | −2.819 |
| Tenon | — | +33.401 | −41.199 | −35.154 | −29.083 | −23.038 | −16.967 | −10.922 | −4.851 | +1.219 |

| SECTION | 20 | 21 | 21A | 22 | 23 |
|---|---|---|---|---|---|
| A-A | +8.230 | +10.668 | +12.090 | +13.132 | — |
| B-B | +8.992 | +11.481 | +12.7 | +14.046 | — |
| C-C | +14.046 | +18.440 | +20.701 | +22.809 | — |
| D-D | +19.685 | +26.137 | +20.413 | +32.563 | — |
| E-E | +25.349 | +33.833 | +38.506 | +42.316 | — |
| F-F | +29.388 | +39.319 | +44.628 | +49.276 | — |
| G-G | +30.988 | +39.319 | +47.117 | +52.07 | — |
| Tenon | +6.096 | +7.874 | — | +9.652 | — |
| A-A | +13.868 | +22.276 | +28.169 | +34.087 | +50.038 |
| B-B | +20.955 | +27.381 | +30.48 | +33.604 | −50.038 |
| C-C | +20.218 | +25.222 | +27.508 | +29.769 | −54.102 |
| D-D | +14.122 | +16.51 | +17.424 | +18.313 | −55.626 |
| E-E | +5.334 | +3.658 | −2.210 | +0.787 | −54.102 |
| F-F | −2.083 | −6.452 | −9.474 | −12.497 | −50.038 |
| G-G | −6.655 | −12.192 | −15.723 | −19.253 | −46.99 |
| Tenon | +7.264 | +13.335 | — | +19.380 | — |

The blade illustrated in FIGs. 1-5 was designed for a WEstinghouse BB73 turbine, for use in the L-1R row. The blade 30, having an airfoil portion 32, a root portion 34, and a platform portion 36, is wired to adjacent blades with a lashing wire 38. The tenon 40 is used to connect the blade 30 to adjacent blades through a shroud (not shown).

The blade depicted in FIGS. 1-5 has been commercially produced by the Westinghouse Electric Corporation and was designed the TS1253A and 1254A. As shown in he drawings, these blades were lashed and shrouded and thus produced certain tuning effects as mentioned previously.

In redesigning the blade illustrated in FIGS. 1-5 for a retrofit, a need eixsted to eliminate traditional weak links such as lashign wires and tenons, to enhance the speed cycling capacity of the blade, to increase strength and to avoid aeroelastic instability. Moreover, the redesign should be effected using the same rotor grooves to minimize machining of the rotor.

SUMMARY OF THE INVENTION

Objects of the present invention are to provide a retrofit blade of increased strength and without weak links such as lashing wires and tenons, capable of enhanced speed cycling capacity and not susceptible to aeroelastic instability.

Another object of the present invention is to provide a retrofit blade which uses the same rotor groove as the pre-existing blade.

These and other objects of the invention are met by providing a freestanding, mixed tuned, taper-twisted steam turbine blade having an X—X axis parallel to a rotor axis, and including a root portion, a platform portion connected to the root portion, and an airfoil portion connected to the platform portion and having a leading edge, a trailing edge, a convex suction-side surface, a concave pressure-side surface and a prfiled tip, the platform portion having a concave edge, a convex edge, a first end in vertical proximity to the leading edge of the airfoil portion and a second end in vertical proximity to the trailing edge of the airfoil portion, the concave edge being sloped towards a root center line radius at a predetermined angle of slope to define a sloped surface and having a sloped flat cut-out surface formed at the second end, the flat cut-out surface having the same predetermined angle of slope as the concave edge and sloping towards the X—X axis.

Preferably, the predetermined angle of slope is about 15°.

These and other features and advantages of the freestanding, mixed tuned, taper-twisted steam-turbine blade of the present invention will become more apparent with reference to the following detailed description and drawings.

Figure 1:
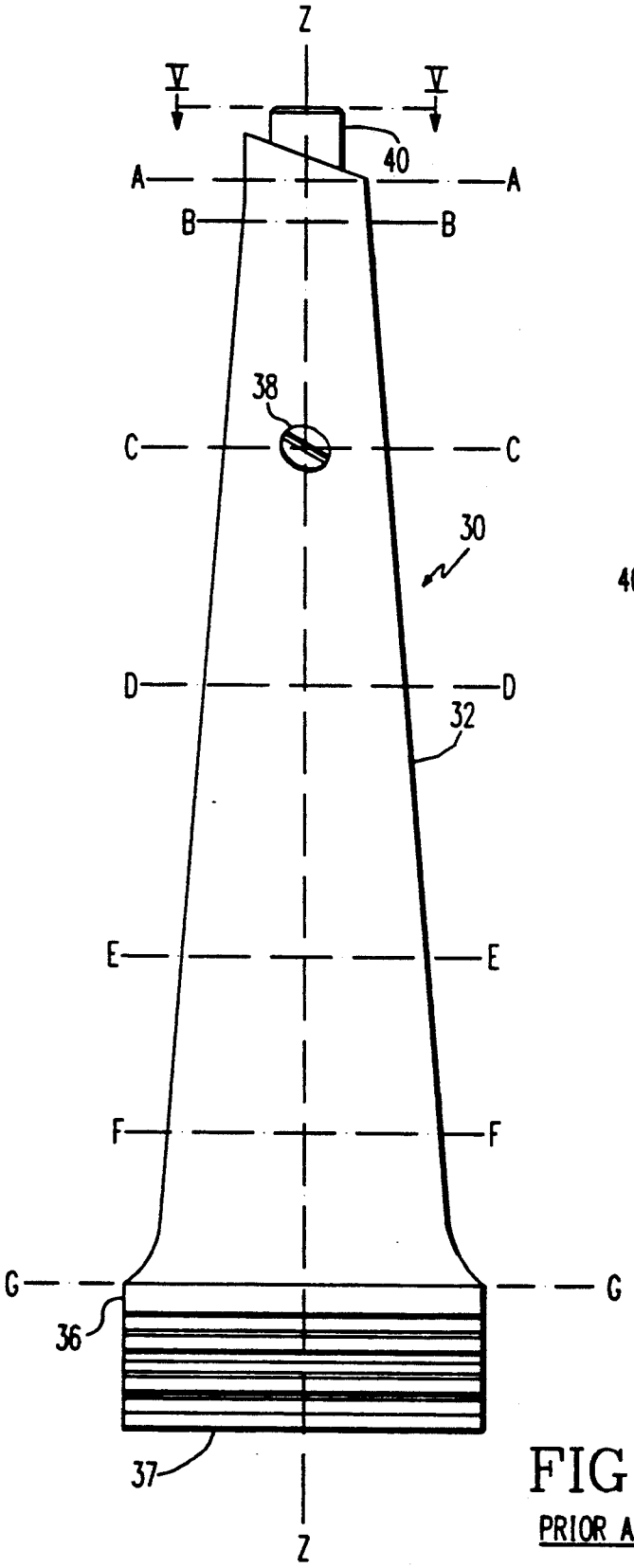
FIG. 1 PRIOR ART
FIG. 1 is a side elevational view of a steam turbine blade of the prior art.
Figure 5:
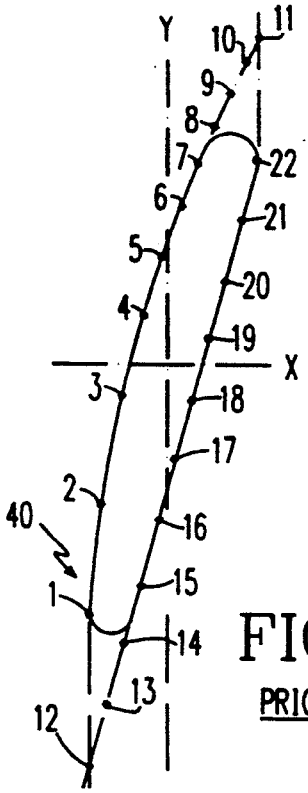
FIG. 5 PRIOR ART
FIG. 5 shows the tenon section V—V of FIG. 1 and further showing spline interpolatin points for quantifying shape of each of the sections relative to points 1-22 as those points relate to the X—X and Y—Y axes of the blade.
Figure 2:
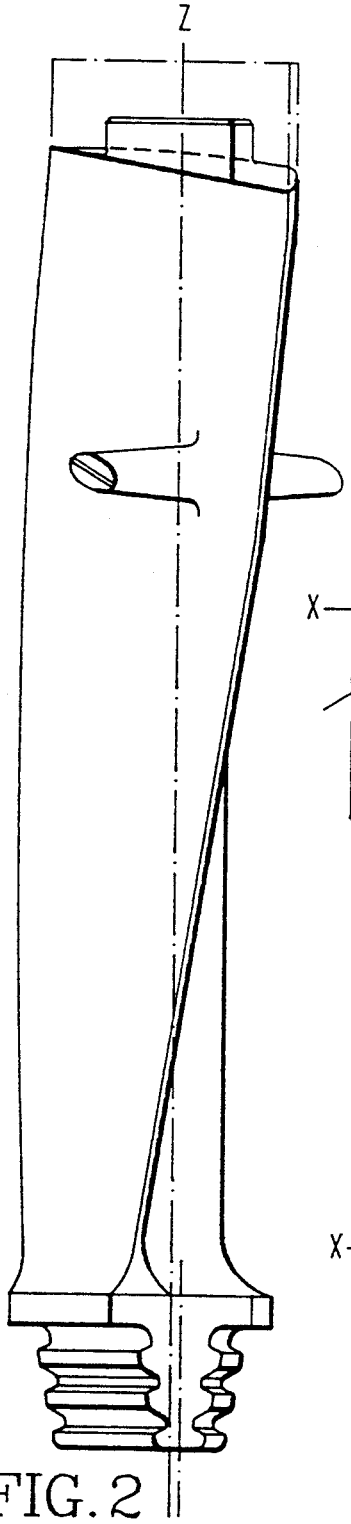
FIG. 2 PRIOR ART
FIG. 2 is an end view of the steam turbine blade of FIG. 1.
Figure 3:
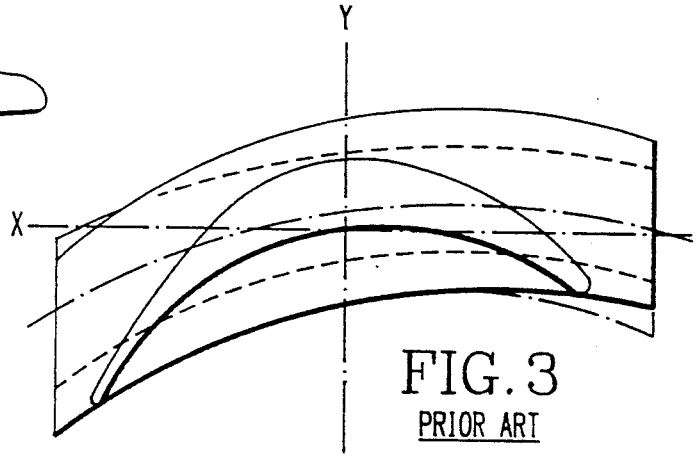
FIG. 3 PRIOR ART
FIG. 3 is a top view of the steam turbine blade of FIG. 1.
Figure 4:
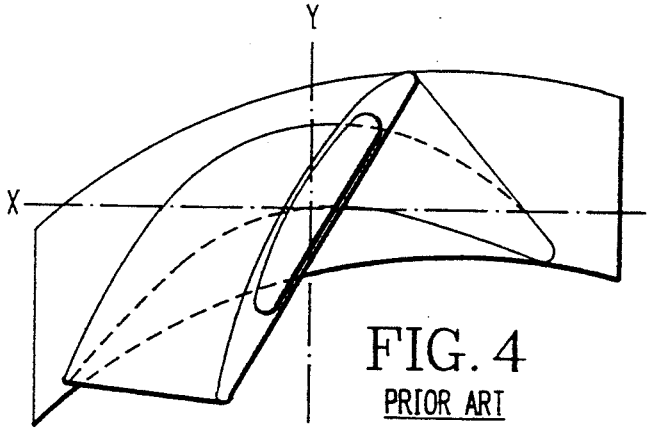
FIG. 4 PRIOR ART
FIG. 4 is a sectional view of the F—F section of FIG. 1, overlaid on the platform portion of the steam turbine blade and showing the X—X and Y—Y axes of the blade.
Figure 6:
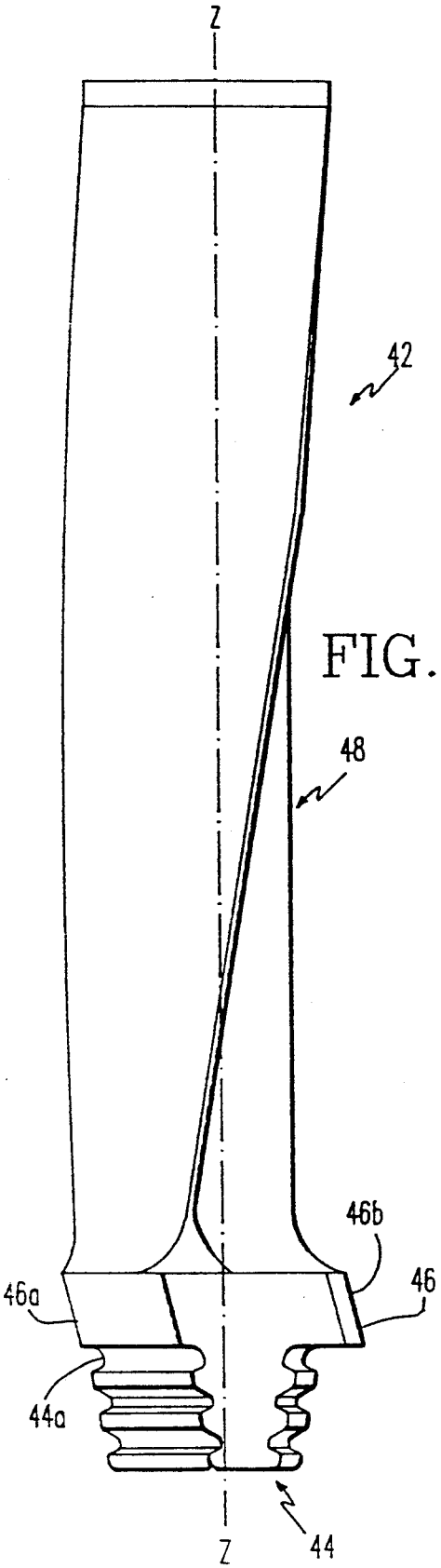
Figure 8:
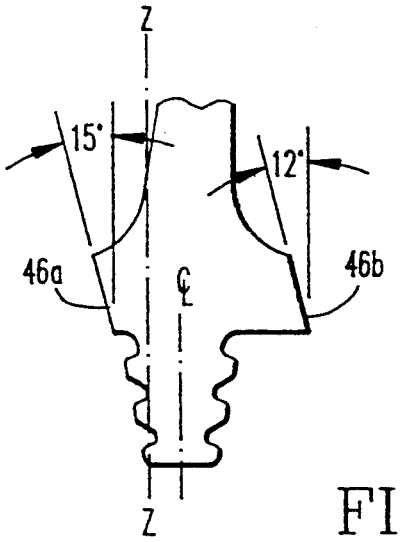
Figure 9:
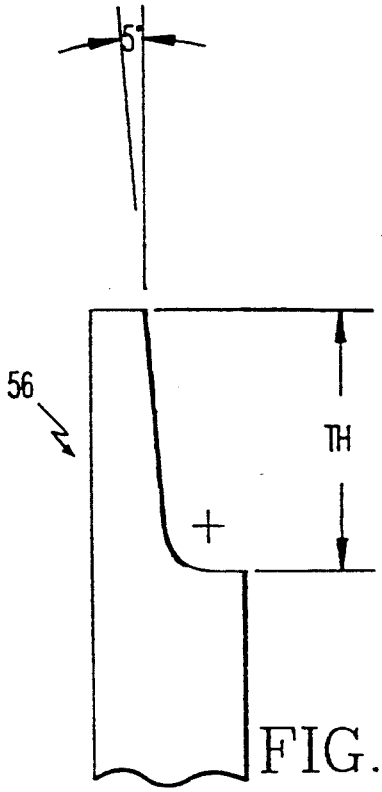
Figure 7:
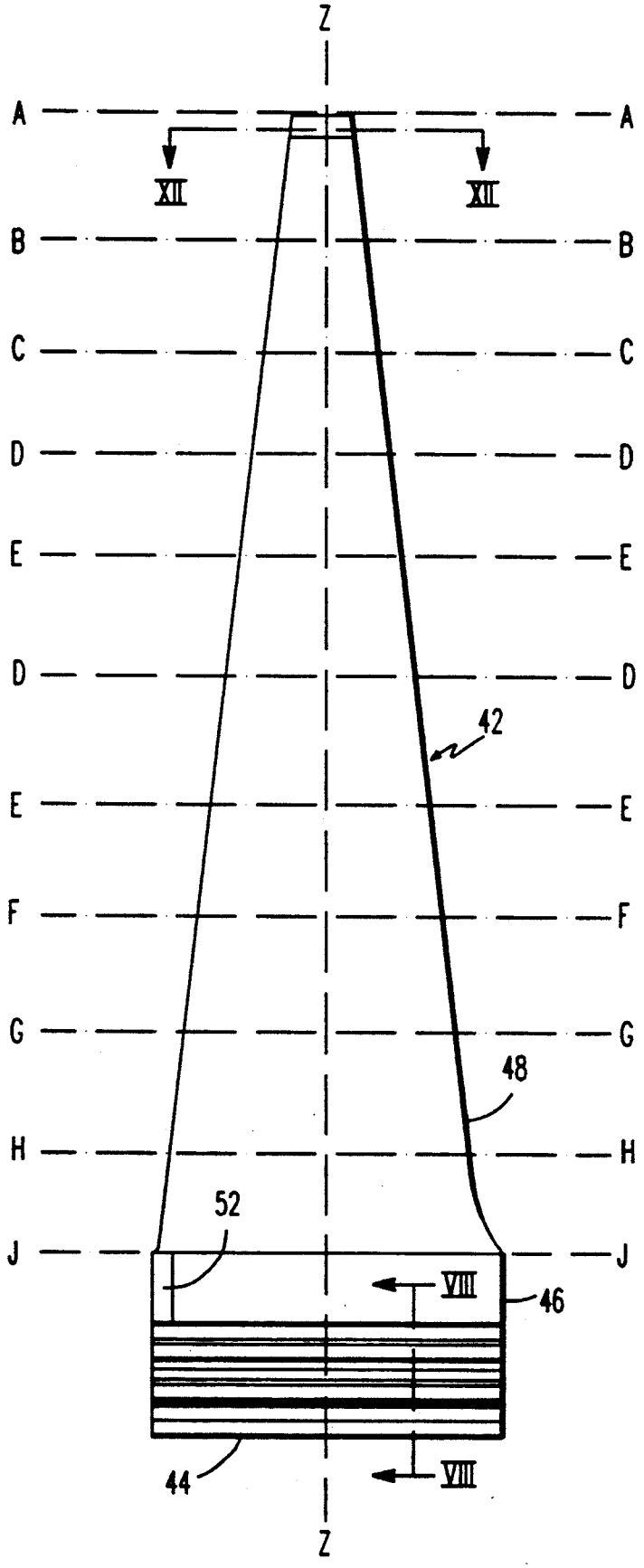
Figure 10:
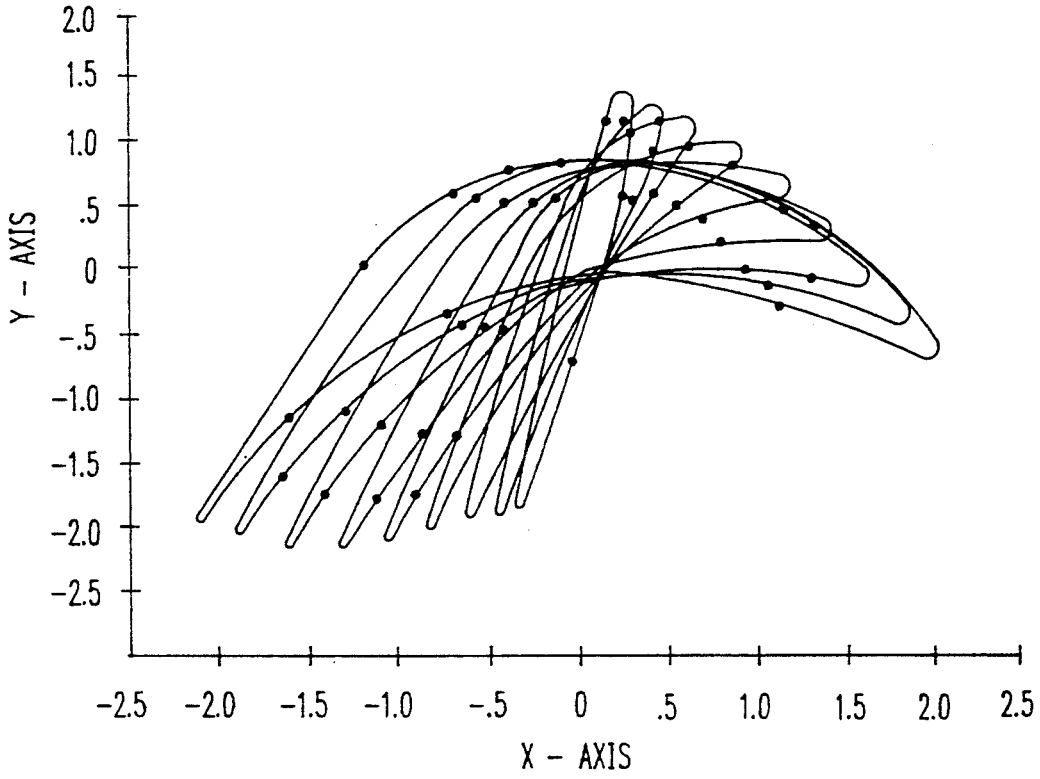
Figure 11:
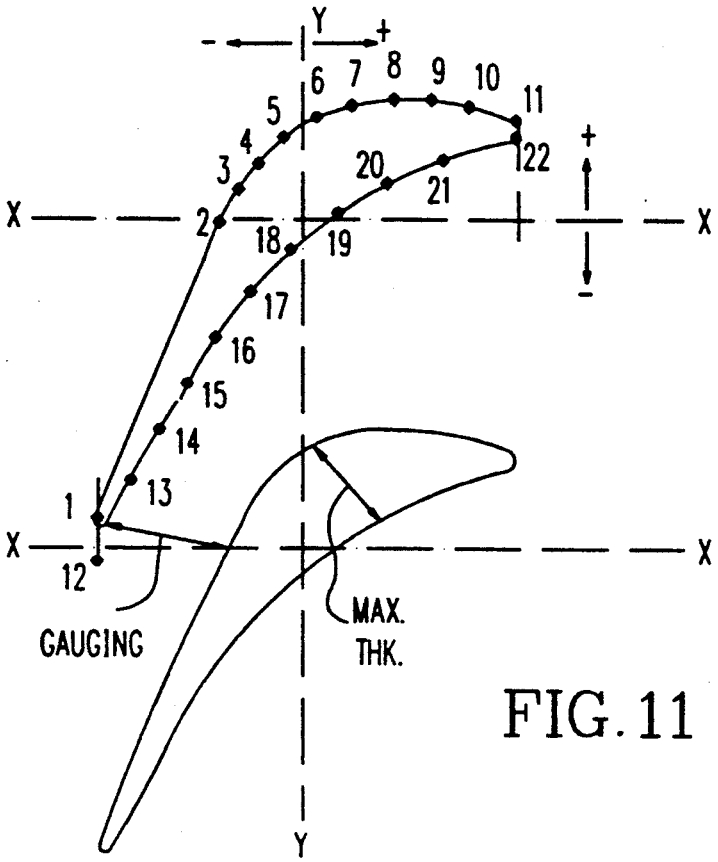
Figure 12:
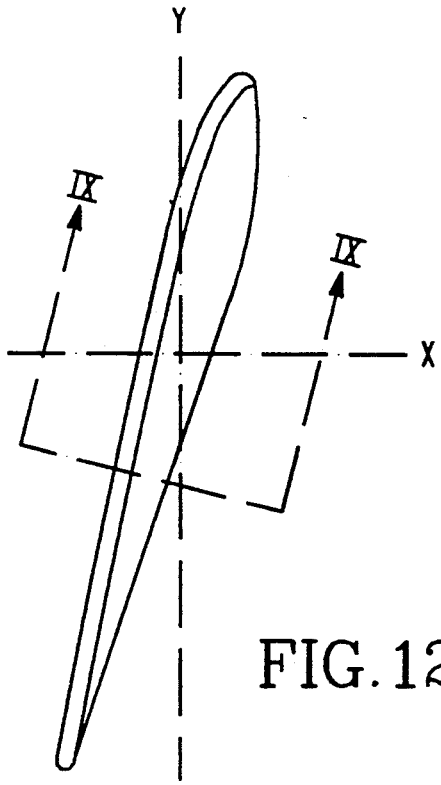
Figure 13:
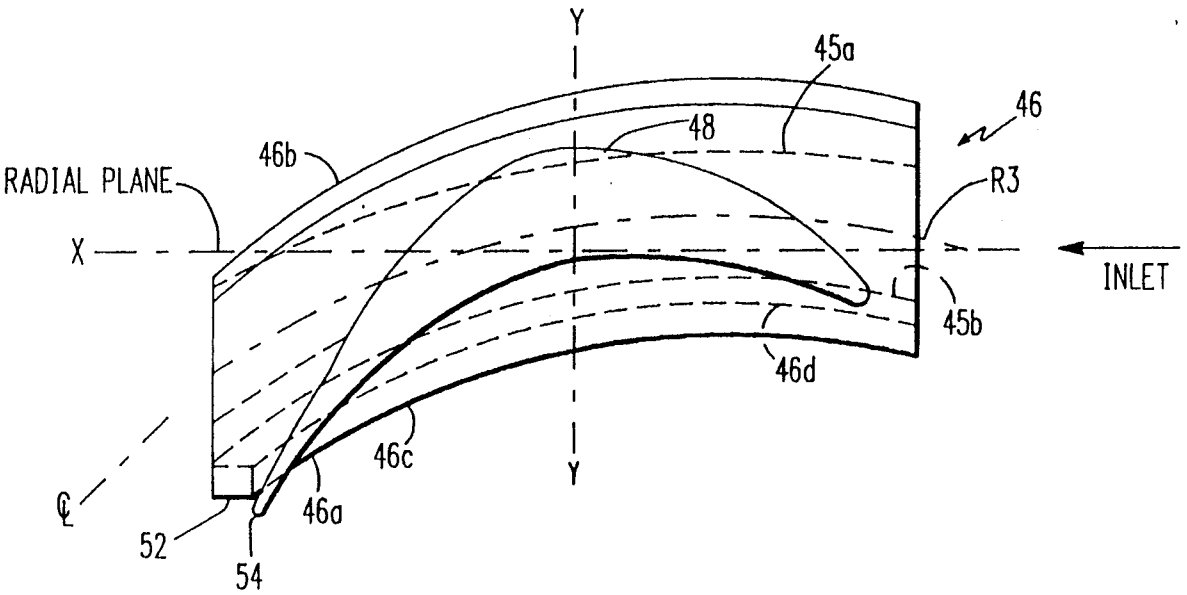
Figure 13A:
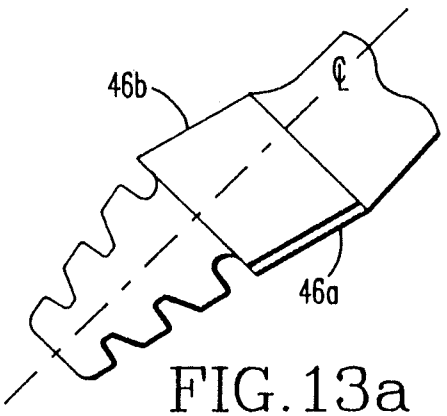
Figure 14:
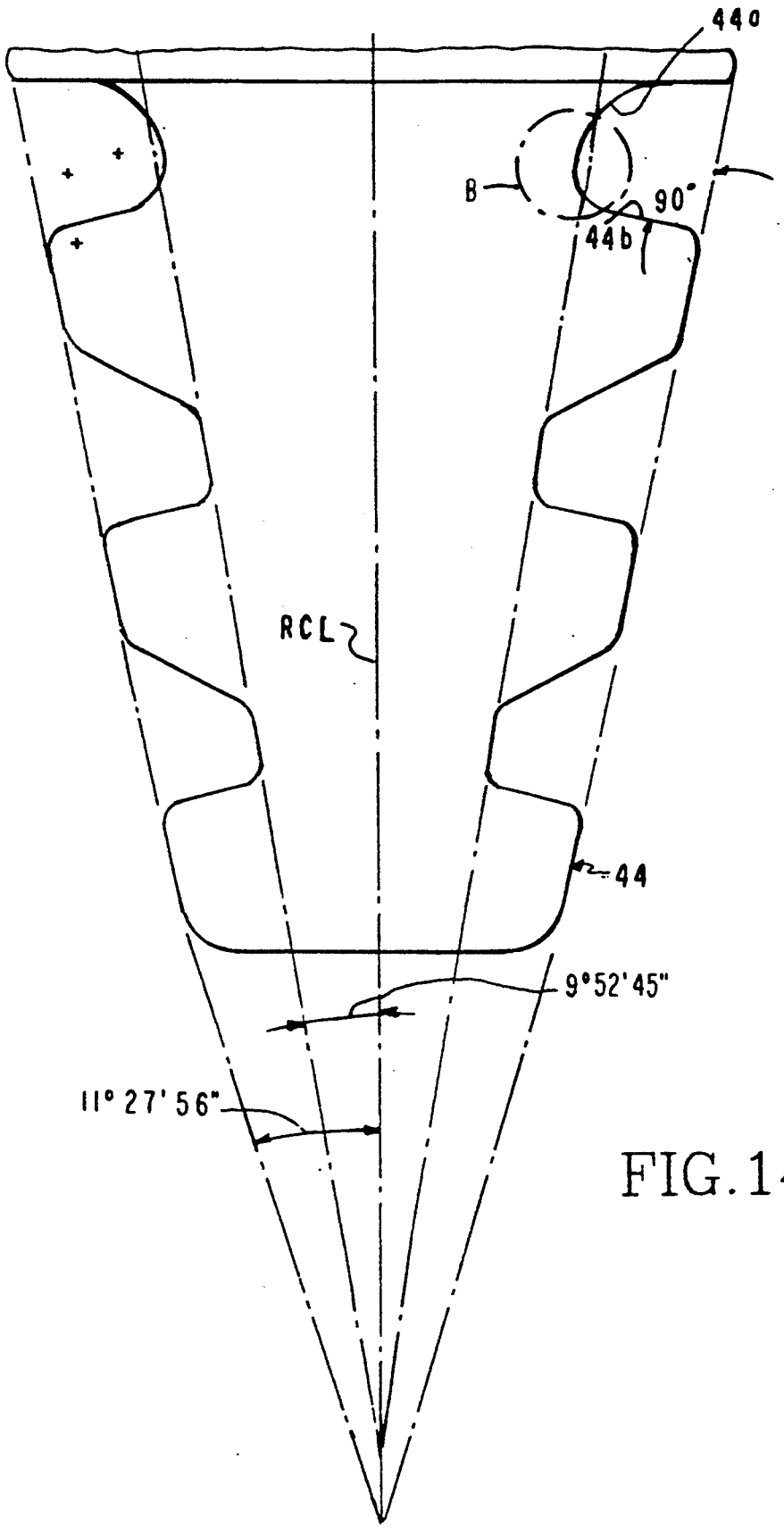

FIG. is an end view of a steam turbine blade according to the present invention;

FIG. 7 is a side elevational view of the steam turbine blade according to FIG. 6;

FIG. 8 is a secitonal view taken along section VIII—VIII of FIg. 7;

FIG. 9 is an enlarged view of the tip portion of the airofil of FIG. 6 as taken along section IX-IX of FIG. 12;

FIG. 10 is a stacked plot showing the various sections illustrated in FIG. 7;

FIG. 11 shows a typical section of the steam turbine blade according to FIG. 6 and illsutrating the spline interpolation points for quantigying blade dimensions and furthe showing two adjacent blades in the blade row for the purpose of illustrating gauging;

FIG. 12 illustrates the XII—XII section of the steam turbine blade of FIG. 7;

FIG. 13 shows the base section overlaid on a plan view of the platform portion on the X—X and Y—Y axes;

FIG. 13(*a*) is an end view of the root portion in relation to the platform portion; and FIG. 14 is an end view of the root portion of the steam turbine blade according to FIG. 6.

Figure 15:
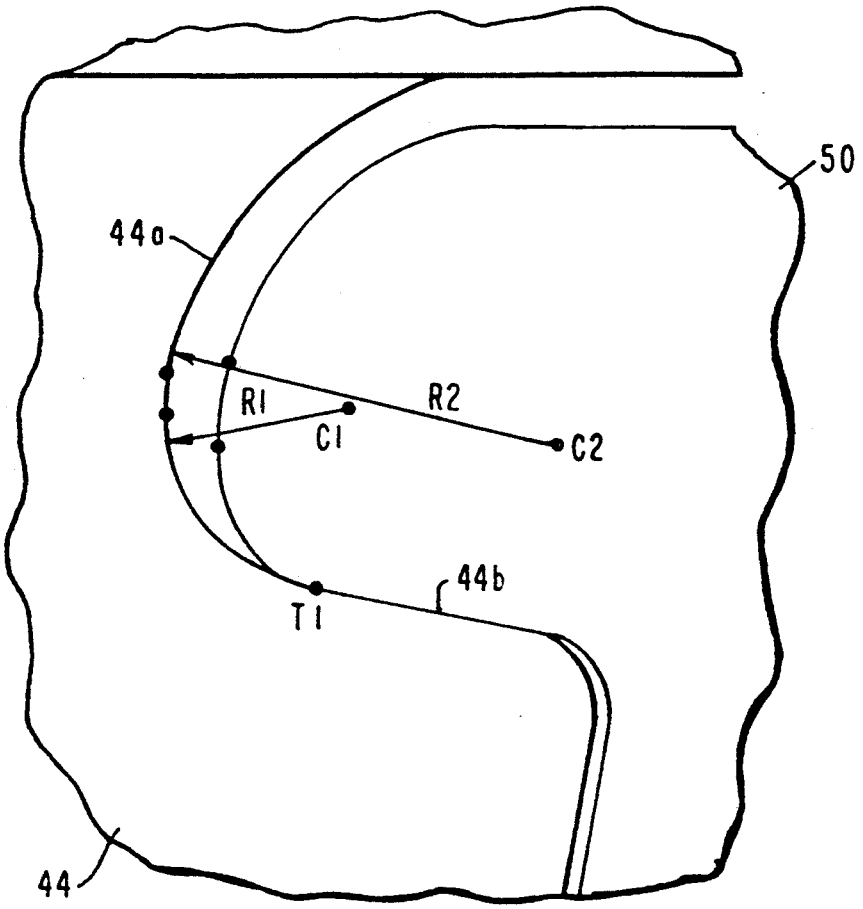

FIG. 15 is an enlarged end view showing a root and groove of the present invention.

DETAILED DESCRIPTION OF THE DRAWINGS

Referring now to FIGS. 6 and 7, a steam turbine blade according to the present invention is generally referred to by the numeral 42 and includes a root portion 44, a platform portion 46 and an airfoil portion 48. FIG. 7 illustrates the basic airfoil sections A—A through J—J, with the distance from the platform indicated on the right-hand side in inches, as well as millimeters shown in parenthesis. Section J—J is the base section and section A—A is the tip section. The tip section is profiled (as further illustrated in its designated row, which for the BB73 L-1R row has 120 blades, the blades have one of two profile tip lengths, and the two different lengths are alternated for the adjacent blades so that half the blades are of one length and the other half are of the other length. The changes in the profile ti length coupled with an enlarged tip section (which lowered and second mode relative to first mode for turning purposes) result in a maximum change of frequency possible for the first mode blade alone frequency ("blade alone" stationary frequency is determiend by testing the resonant frequencies of the blade while detached from the rotor; hwoever the "blade alone" rotating frequency is determined by testing ther esonant frequencies of the blade while the rotor portion does not vibrate). This enabled the mixed tuning requirements to be met without the additional aid of sequencing of the specific blades around the row, provided a profile tip length close to 0.305 is used for the longer length. The profile tip lengths in the preferred embodiment were set at 0.075 inches (1.905 mm) and 0.200 to 0.305 inches (5.08 mm to 7.747 mm). This results in the blades of the row having a 4 Hz first mode blade alone frequency seapration, which ensures that aeroelastic instability is avoided. In other words, the blade with the longer length profile tip having the 0.200 to 0.305 inch (5.08 mmto 7.747 mm) profile has a frequency about 4 Hz higher than the blade with the shorter length profile tip having the 0.075 inch (1.905 mm) profile. At the same time, the tuning requirements fr the first and second mode disk system frequencies (frequencies of the blades when the rotor vibrates with the blades) and the second mode blade alone frequency were established within prescribed guidelines.

The affect of the tip profile in meeting the tuning requirements for the first and second modes of vibration were in part the result of the redesign of the airfoil sections as compared to the prior art blade illustrated in FIGS. 1-5. In particular, the airfoil portion of the present invention has coordinate points listed in the following Table II:

TABLE II

BASIC BLADE SECTION COORDINATE POINTS (inches)

HORIZONTAL CONVEX

| SECTION | 1 | 2 | 3 | 4 | 5 | 6 | 7 | 8 | 9 | 10 | 11 |
|---|---|---|---|---|---|---|---|---|---|---|---|
| A-A | −.3941 | +.0121 | +.0223 | +.0340 | +.0472 | +.0620 | +.0788 | +.0979 | +.1196 | +.1437 | +.3122 |
| B-B | −.5137 | −.0387 | −.0188 | +.0082 | +.0425 | +.0840 | +.1312 | +.1826 | +.2365 | +.2914 | +.4786 |
| C-C | −.6567 | −.1121 | −.0796 | −.0344 | +.0249 | +.0980 | +.1812 | +.2726 | +.3690 | +.4675 | +.6795 |
| D-D | −.8558 | −.2320 | −.1827 | −.1181 | −.0303 | +.0811 | +.2135 | +.3599 | +.5150 | +.6724 | +.9124 |
| E-E | −1.0993 | −.4151 | −.3428 | −.2524 | −.1237 | +.0458 | +.2460 | +.4623 | +.6805 | +.8936 | +1.1585 |
| F-F | −1.3602 | −.6443 | −.5384 | −.4062 | −.2207 | +.0172 | +.2958 | +.5849 | +.8562 | +1.1087 | +1.3866 |
| G-G | −1.6609 | −.9240 | −.7747 | −.5850 | −.3183 | +.0140 | +.3848 | +.7454 | +1.0622 | +1.3448 | +1.6313 |
| H-H | −1.9316 | −1.1680 | −.9699 | −.7194 | −.3745 | +.0466 | +.4907 | +.9055 | +1.2557 | +1.5581 | +1.8470 |
| J-J | −2.1360 | −1.3901 | −1.1569 | −.8519 | −.4369 | +.0532 | +.5471 | +1.0127 | +1.3939 | +1.7135 | +2.0140 |

HORIZONTAL CONCAVE

| SECTION | 12 | 13 | 14 | 15 | 16 | 17 | 18 | 19 | 20 | 21 | 22 | 23 |
|---|---|---|---|---|---|---|---|---|---|---|---|---|
| A-A | −.3941 | −.2587 | −.1911 | −.1152 | −.0343 | +.0481 | +.1284 | +.2016 | +.2577 | +.2919 | +.3122 | — |
| B-B | −.5137 | −.3665 | −.2859 | −.1953 | −.0972 | +.0053 | +.1091 | +.2110 | +.3093 | +.4009 | +.4786 | — |
| C-C | −.6567 | −.4945 | −.3952 | −.2835 | −.1629 | −.0366 | +.0949 | +.2316 | +.3732 | +.5197 | +.6795 | — |
| D-D | −.8558 | −.6772 | −.5633 | −.4392 | −.3038 | −.1522 | +.0180 | +.2090 | +.4202 | +.6473 | +.9124 | — |
| E-E | −1.0993 | −.9015 | −.7661 | −.6193 | −.4588 | −.2755 | −.0618 | +.1894 | +.4781 | +.7880 | +1.1585 | — |
| F-F | −1.3602 | −1.1408 | −.9783 | −.8069 | −.6232 | −.4047 | −.1349 | +.1873 | +.5508 | +.9296 | +1.3866 | — |
| G-G | −1.6609 | −1.4151 | −1.2164 | −.9949 | −.7490 | −.4580 | −.1133 | +.2898 | +.7106 | +1.1281 | +1.6313 | — |
| H-H | −1.9316 | −1.6541 | −1.4150 | −1.1347 | −.8142 | −.4433 | −.0269 | +.4354 | +.8869 | +1.3210 | +1.8470 | — |
| J-J | −2.1360 | −1.8342 | −1.5684 | −1.2447 | −.8605 | −.4154 | +.0625 | +.5594 | +1.0309 | +1.4764 | +2.0140 | — |

VERTICAL CONVEX

| SECTION | 1 | 2 | 3 | 4 | 5 | 6 | 7 | 8 | 9 | 10 | 11 |
|---|---|---|---|---|---|---|---|---|---|---|---|
| A-A | −1.8273 | +.7590 | +.8195 | +.8797 | +.9396 | +.9991 | +1.0581 | +1.1164 | +1.1738 | +1.2302 | +1.5638 |
| B-B | −1.8753 | +.5876 | +.6710 | +.7518 | +.8299 | +.9050 | +.9760 | +1.0439 | +1.1100 | +1.1751 | +1.3909 |
| C-C | −1.9210 | +.4110 | +.5228 | +.6290 | +.7289 | +.8197 | +.8996 | +.9708 | +1.0347 | +1.0947 | +1.2161 |
| D-D | −1.9993 | +.1875 | +.3402 | +.4856 | +.6200 | +.7339 | +.8239 | +.8868 | +.9251 | +.9482 | +.9722 |
| E-E | −2.0717 | −.0297 | +.1782 | +.3770 | +.5566 | +.6954 | +.7850 | +.8198 | +.8021 | +.7535 | +.6801 |
| F-F | −2.1322 | −.2225 | +.0472 | +.3026 | +.5276 | +.6892 | +.7704 | +.7563 | +.6603 | +.5206 | +.3457 |
| G-G | −2.1266 | −.3461 | −.0047 | +.3126 | +.5782 | +.7402 | +.7781 | +.6852 | +.4943 | +.2542 | −.0261 |
| H-H | −2.0371 | −.4003 | +.0077 | +.3675 | +.6572 | +.8063 | +.7901 | +.6183 | +.3431 | +.0164 | −.3535 |
| J-J | −1.9368 | −.3979 | +.0448 | +.4413 | +.7206 | +.8285 | +.7510 | +.5219 | +.1969 | −.1909 | −.6300 |

VERTICAL CONCAVE

| SECTION | 12 | 13 | 14 | 15 | 16 | 17 | 18 | 19 | 20 | 21 | 22 | 23 |
|---|---|---|---|---|---|---|---|---|---|---|---|---|
| A-A | −2.3430 | −1.5261 | −1.2181 | −.9120 | −.6072 | −.3028 | +.0021 | +.3088 | +.6193 | +.9327 | +1.2495 | −1.8721 |
| B-B | −2.4311 | −1.5739 | −1.2646 | −.9580 | −.6535 | −.3508 | −.0484 | +.2545 | +.5587 | +.8650 | +1.1832 | −1.9224 |
| C-C | −2.3560 | −1.6205 | −1.3116 | −1.0070 | −.7054 | −.4065 | −.1100 | +.1842 | +.4760 | +.7654 | +1.0691 | −1.9664 |
| D-D | −2.3239 | −1.6965 | −1.3818 | −1.0709 | −.7650 | −.4661 | −.1780 | +.0972 | +.3369 | +.6027 | +.8575 | −2.0458 |
| E-E | −2.3360 | −1.7590 | −1.4332 | −1.1120 | −.7977 | −.4949 | −.2129 | +.0361 | +.2409 | +.4103 | +.5717 | −2.1182 |
| F-F | −2.3634 | −1.7982 | −1.4517 | −1.1091 | −.7732 | −.4572 | −.1813 | +.0281 | +.1559 | +.2142 | +.2298 | −2.1780 |
| G-G | −2.3352 | −1.7643 | −1.3933 | −1.0345 | −.6929 | −.3827 | −.1374 | +.0046 | +.0250 | −.0351 | −.1533 | −2.1719 |
| H-H | −2.2253 | −1.6522 | −1.2622 | −.8991 | −.5728 | −.2936 | −.1036 | −.0450 | −.1180 | −.2662 | −.4943 | −2.0830 |
| J-J | −2.1222 | −1.5280 | −1.1144 | −.7427 | −.4362 | −.2107 | −.1013 | −.1239 | −.2293 | −.4663 | −.7904 | −1.9845 |

BASIC BLADE SECTION COORDINATE POINTS (millimeters)

(HORIZONTAL CONVEX)

| SECTION | 1 | 2 | 3 | 4 | 5 | 6 | 7 | 8 | 9 | 10 | 11 |
|---|---|---|---|---|---|---|---|---|---|---|---|
| A-A | −10.0101 | +0.3073 | +0.5664 | +0.8636 | +1.1989 | +1.5748 | +2.0015 | +2.4867 | +3.0378 | +3.6499 | +7.9299 |
| B-B | −13.0478 | −0.9830 | −0.4775 | +0.2083 | +1.0795 | +2.1336 | +3.3325 | +4.6380 | +6.0071 | +7.4016 | +12.1564 |
| C-C | −16.6802 | −2.8473 | −2.0218 | −0.8738 | +0.6325 | +2.4892 | +4.6025 | +6.9240 | +9.3726 | +11.8745 | +17.2593 |
| D-D | −21.7373 | −5.8928 | −4.6406 | −2.9997 | −0.7696 | +2.0599 | +5.4229 | +9.1415 | +13.081 | +17.0790 | +23.1750 |
| E-E | −27.9222 | −10.5435 | −8.7071 | −6.4110 | −3.1420 | +1.1633 | +6.2484 | +11.7424 | +17.2843 | +22.6974 | +29.4259 |
| F-F | −34.5491 | −16.3652 | −13.6754 | −10.3175 | −5.6058 | +0.4369 | +7.5133 | +14.8565 | +21.7475 | +28.1610 | +35.2196 |
| G-G | −42.1869 | −23.4696 | −19.6774 | −14.859 | −8.0848 | +9.7739 | +9.7739 | +18.9332 | +26.9779 | +34.1579 | +41.4350 |
| H-H | −49.0126 | −29.6672 | −24.6355 | −18.2728 | −9.5123 | +12.4638 | +12.4638 | +22.9997 | +31.8948 | +39.5757 | +46.9138 |
| J-J | −54.2544 | −35.3085 | −29.3853 | −21.6383 | −11.0973 | +13.8963 | +13.8963 | +25.7226 | +35.4051 | +43.5229 | +51.1556 |

(HORIZONTAL CONCAVE)

| SECTION | 12 | 13 | 14 | 15 | 16 | 17 | 18 | 19 | 20 | 21 | 22 | 23 |
|---|---|---|---|---|---|---|---|---|---|---|---|---|
| A-A | −10.0101 | −6.5710 | −4.8539 | −2.9261 | −0.8712 | +1.2217 | +3.2614 | +5.1206 | +6.5456 | +7.4143 | +7.9299 | — |
| B-B | −13.0478 | −9.3091 | −7.2619 | −4.9606 | −2.4688 | +0.1346 | +2.7711 | +5.3594 | +7.8562 | +10.1829 | +12.1564 | — |
| C-C | −16.6802 | −12.5603 | −10.0381 | −7.2009 | −4.1376 | −0.9296 | +2.4105 | +5.8826 | +9.4793 | +13.2004 | +17.2593 | — |
| D-D | −21.7373 | −17.2009 | −14.3078 | −11.1557 | −7.7165 | −3.8659 | +0.4572 | +5.3086 | +10.6731 | +16.4414 | +23.1750 | — |
| E-E | −27.9222 | −22.8981 | −19.4589 | −15.7302 | −11.6535 | −6.9977 | −1.5697 | +4.8108 | +12.1437 | +20.0152 | +35.2916 | — |
| F-F | −34.5491 | −23.9763 | −24.8488 | −20.4953 | −15.8293 | −10.2794 | −3.4265 | +4.7574 | +13.9903 | +23.6118 | +29.4259 | — |
| G-G | −42.1869 | −35.9435 | −30.8966 | −25.2705 | −19.0246 | −11.6332 | −2.8778 | +7.3609 | +18.0492 | +28.6537 | +41.4350 | — |
| H-H | −49.0126 | −42.0141 | −35.941 | −28.8214 | +20.6807 | −11.2598 | −0.6833 | +11.0592 | +22.5273 | +33.5534 | +46.9138 | — |
| J-J | −54.2544 | −46.5887 | −39.8374 | −31.6154 | −21.8567 | −10.5512 | +1.5875 | +14.2088 | +26.1849 | +37.5006 | +51.1556 | — |

TABLE II-continued

| SECTION | (VERTICAL CONVEX) 1 | 2 | 3 | 4 | 5 | 6 | 7 | 8 | 9 | 10 | 11 |
|---|---|---|---|---|---|---|---|---|---|---|---|
| A-A | −46.4134 | +19.2786 | +20.8153 | +22.3444 | +23.8658 | +26.8757 | +26.8757 | +28.3566 | +29.8145 | +31.2471 | +39.7205 |
| B-B | −47.6326 | +14.9250 | +17.0434 | +19.0958 | +21.0795 | +22.987 | +24.7904 | +26.5151 | +28.194 | +29.8475 | +35.3289 |
| C-C | −48.7934 | +10.4394 | +13.2791 | +15.9766 | +18.5141 | +20.8204 | +22.8498 | +24.6583 | +26.2814 | +27.8054 | +30.8889 |
| D-D | −50.7822 | +4.7625 | +8.6411 | +12.3342 | +15.7486 | +18.6411 | +20.9271 | +22.5247 | +23.4975 | +24.0843 | +24.6939 |
| E-E | −52.6212 | −0.7544 | +4.5263 | +9.578 | +14.1376 | +17.6632 | +19.939 | +20.8229 | +20.3733 | +19.1389 | +17.272 |
| F-F | −54.1579 | −5.6515 | +1.1989 | +7.6860 | +13.4010 | +17.5057 | +19.5682 | +19.2100 | +16.7716 | +13.2232 | +8.636 |
| G-G | −54.0156 | −8.7909 | −0.1194 | +7.9400 | +14.6863 | +18.8011 | +19.7637 | +17.4041 | +12.5552 | +6.4567 | −0.508 |
| H-H | −51.7423 | −10.1676 | +0.1956 | +9.3345 | +16.6929 | +20.4800 | +20.0685 | +15.7048 | +8.7147 | +0.4166 | −8.89 |
| J-J | −49.1947 | −10.1067 | +1.1379 | +11.2090 | +18.3032 | −21.0439 | +19.0754 | +13.2563 | +5.0013 | −4.8489 | −16.002 |

| SECTION | (VERTICAL CONCAVE) 12 | 13 | 14 | 15 | 16 | 17 | 18 | 19 | 20 | 21 | 22 | 23 |
|---|---|---|---|---|---|---|---|---|---|---|---|---|
| A-A | −59.5122 | −38.7629 | −30.9397 | −23.1648 | −15.4229 | −7.6911 | +0.0533 | +7.8435 | +15.7302 | +23.6906 | +31.7373 | −47.498 |
| B-B | −61.7499 | −39.9771 | −32.1208 | −24.3332 | −16.5989 | −8.9103 | −1.2294 | +6.4643 | +14.1910 | −21.971 | +30.0533 | +48.768 |
| C-C | −59.8424 | −41.1607 | −33.3146 | −25.5778 | −17.9172 | −10.3251 | −2.794 | +4.6787 | +12.0904 | +19.4412 | +27.1551 | +49.784 |
| D-D | −59.0271 | −43.0911 | −35.0977 | −27.2009 | −19.431 | −11.8389 | −4.5212 | +2.4689 | +8.5573 | +15.3086 | +21.7805 | −51.816 |
| E-E | −59.3344 | −44.6786 | −36.4033 | −28.2448 | −20.2616 | −12.5705 | −5.4076 | +0.9169 | +6.1189 | +10.4216 | +14.5212 | −53.594 |
| F-F | −60.0304 | −45.6743 | −36.8732 | −28.1711 | −19.6393 | −11.6129 | −4.6050 | +0.7137 | +3.9599 | +5.4407 | +5.8369 | −55.118 |
| G-G | −59.3141 | −44.8132 | −35.3898 | −26.2763 | −17.5997 | −9.7206 | −3.4900 | +0.1168 | +0.635 | −0.8915 | −3.8938 | −55.118 |
| H-H | −56.5223 | −41.9659 | −32.0599 | −22.8371 | −14.5491 | −7.4574 | −2.6314 | −1.143 | −2.9972 | −6.7615 | −12.5552 | −52.832 |
| J-J | −53.9039 | −38.8112 | −28.3058 | −18.8646 | −11.0795 | −5.3518 | −2.5730 | −3.1471 | −5.8242 | −11.8440 | −20.0762 | −50.292 |

The enlarged tip section lowered both first and second modes through "mass control", but substantially lowered second mode relative to first mode. Both modes were raised an equal amount to the correct level of blade disc system frequencies by "beefing up" the lower sections. In addition the "beefed up" lower sections (providing stiffness control), added increased vibratory strength. Furthermore, increased vibratory strength for the root (other than speed cycling) was accomplished by changing the root neck profile (increased radius at the upper-most neck, etc.). Vibratory strength is needed for the untuned modes such as the third and fourth modes. Furthermore, due to the stiffer lower sections, the frequencies of the third and fourth modes are higher, and this feature can be related to an additional icnrease in strength both for the lower sections and the root.

The coordinate points in Table II define an airfoil shape which is different in many substantial ways from the airfoil described in Table I. Although the blade airfoil has a height of 14.57 inches (370.07 mm), the platform is substantially thicker in the radial direction than a typical blade (along with other features which will be described later). The lower sections of the airfoil portion (base through ⅜]or J—J through F—F) and the ⅛ section (8-H) along with a lower stagger angle, raise both the first and second mode frequencies by the same amount. This provides stiffness control for the overall blade structure. At the same time, the sections near the tip (B—B and A—A, corresponding to the ⅞ and tip sections) were enlarged to lower both first and second mode frequencies by mass control. However, the second mode frequency was lowered more than the first mode frequency by these changes in airfoil dimensions and the net result was that the second mode frequency was lowered relative to the first mode frequency, and this was essential to meeting the tuning requirements for both first and second modes. As a consequence, changes in the profile tip length resulted in the maximum change of frequency possible for the first mode blade alone frequency and, as mentioned previously, this enabled the mixed tuning requirements to be met wihtout additional aid of sequencing of specific blades around the row.

The tuning difficulty was to a large extent caused by very flexible integral disc or rotor that resulted in a large spread of frequency between the second mode disc system frequency and the second mode blade alone frequency. This made it very important to precisely design these second mode frequencies and this in turn effected the design of the first mode frequency (system frequency).

Thus, the blade illustrated in FIGS. 6 and 7 was designed as a retrofit to replace the blade illustrated in FIGS. 1–5. The blade in FIGS. 6 and 7 is freestanding, meansing that it is neither lashed nor shrouded as in the previous blade.

The root portion 44 of the blade illustrated in FIGS. 6 and 7 is the same as that of the previous blade, except that the upper-most root neck 44*a* has a different radius. In particular, the radius was increased from 0.0625 inches (1.5875 mm) to 0.-0850 inches (12.159 mm) where indicated in FIG. 14. In addition, the radius to the underside of the platform was increased to 0.180 inches (4.572 mm), and a line joining teh centers of both radii is parallel to the bearing surface 44*b*. These ardii are better illustrated in FIG. 15. These larger radii improved the strength of the root and increased speed cycling capacity by reducing the stress concentration at the neck of the root (44*a*).

Referring to FIG. 15, which is an enlarged view of FIG. 14 at circle B on the right-hand side of the root center line RCL, the rotor 50 has a groove which mates with the root portion 44 so that the bearing surface 44*b* is the surface area of contact between the rotor 50 and the root portion 44 at the upper-most neck 44*a*. The bearing surface 44*b* is substantially planar and, as mentioned previously, is parallel to a line drawn between the centers C1 and $C_2$ of the 0.085 inches (2.159 mm) radius R1 and the 0.18 radius R2, respectively. Moreover, the tangency poin T1 of the 0.085 inches (2.159 mm) radius R1 to the bearing surface 44*b* has a zero offset to the tangency point of the corresponding steeple radius, so that tangency point T1 is common to both. This feature is unique and is possible because the new 0.-85 inches (2.159 mm) radius is substantially larger than the corresponding retrofit steeple radius (the word ¢steeple" referring to the rotor groove configuration). The effect of this is to provide a lsightly larger, thicker root neck than would otherwise be possible at the upper-most root section so nominal stresses and frequencies will be effected the least. Thus, in terms of a comparison to the previous blade, the upper-most root neck illustrated in FIG. 14 is slightly smaller and thinner than the preceding root portion.

Another feature of the present invention which distinguishes it over the previous blade illustrated in FIGS. 1-5 is in the configuration of the platform. Referring to FIGS. 6, 8 and 13, the platform portion 46 has a concave edge 46*a* and a convex edge 46 *b*. The 15° sloped concave platform edge is also referred to as the vertical platform angle. The convex edge 46*b* is angled in the same direction at a 12° angle. When it is stated that the concave edge slopes toward sthe root center line radius R3, this means that both the top and bottom of the concave edge are parallel and concentric to the root center, formed by radius R3. This can be seen in FIG. 13. Another important aspect of the platform according to the present invention is that a flat cut-out 52 is formed at the trailing edge 54 of the airfoil portion 48. The flat cut-out 52 is also illustrated in FIG. 7. The flat cut-out 52 is angled at the same 15° angle as the vertical platform angle and slopes towards the X—X axis. Its flat, 15° sloped surface is formed, for example, by running at 15° angled platform cutter straight out at the 1.084 inches (50.394 mm) dimension. Thus, the top and bottom of the flat cut-out 52 are parallel to the X—X axis, which is linear while the top 46*c* and bottom 46*d* of the concave edge 46*a* are parallel and concentric to the root center line (formed by radius R3) and are thus curvilinear. The cut-out 52 is at the end of the platform underlying the trailing edge 54 of the airfoil portion 48 and has the effect of reducing overhang, which in turns enhances speed cycling capacity. The overhang can be seen in FIG. 6 as the distance between the upper-most root neck 44*a* and the concave ddge 46*a* at the end face of the platform. In the previous blade, the overhang was 0.868 inches (22.047 mm) whereas in the present invention the overhang is 0.246 inches (6.248 mm). The overhang is thus defined as the bottom 46*e* of the platform portion 46 which extends tangentially outwardly at the trailing edge concave side of the platform portion.

To further enhance the speed cycling capcity, the 15° vertical platform angle corresponding to the concave edge 46*a* results in the average center of gravity of the platform in the vertical direction being stacked with respect to the X-Y stacing axis as shown. Without this angle, the center of gravity of the platform would be in the negative vertical direction, resulting in additional tensile stresses on the concave trailing edge of root neck 44*a* which would result in less speed cylcing capacity. Since the platform is relatively thick at 0.948 inches (24.079 mm), stacking of the platform in this design is a significant feature.

FIG. 13 also illustrates as curved parallel broken lines 45*a* and 45*b* the top serration or lug of the root portion, thus illustrating the relative position of the root to the platform and airfoil. The pivot centers and length of radius is also illustrated for each curved line in a preferred embodiment.

Referring to FIG. 9, the profiled tip 56 of the airfoil portion has a length TH of 0.200 to 0.305 inches (5.08 mm to 7.747 mm). Every other blade in the row iwll have a profile length TH of 0.075 inches (1.905 mm). The length is measured from the distal end of the airfoil portion so that in both profile lengths, the overall length of the blade remains 14.57 inches (370.07 mm).

Throughout the drawings, the Z—Z axis is the radial plane which is orthogonal to the X—X and Y—Y axes and is formed at the intersection of the X—X and Y—Y axes. Other characteristics of the blade according to the present invention are listed below with respect to the maximum section thickness and gauging (see FIG. 11):

| SECTION | MAX THK (in.) | MAX THK (mm) | GAUGING |
|---|---|---|---|
| A-A | .265 | 6.731 | .335 |
| B-B | .347 | 8.813 | .404 |
| C-C | .433 | 10.998 | .479 |
| D-D | .514 | 13.055 | .569 |
| E-E | .617 | 15.671 | .643 |
| F-F | .675 | 17.145 | .687 |
| G-G | .779 | 19.786 | .720 |
| H-H | .875 | 22.225 | .764 |
| J-J | .930 | 23.622 | .747 |

Numerous modifications and adaptations of the present invention will be apprent to those so skilled in the art and thus, it is intended by the following claims to cover all such modifications and adaptations which fall within the true spirit and scope of the invention.

What is claimed is:

1. A freestanding mixed tuned taper-twisted steam turbine blade having an X—X axis parallel to a rotor axis, comprising:

a root portion having a root center line defined by a root center line radius;

a platform portion connected to the root portion; and an airfoil portion connected to the platform portion and having a leading edge, a trailing edge, a convex suction-side surface, a concave pressure-side surface and a profiled tip, the platform portion having a concave edge, a convex edge, a first end in vertical proximity to the leading edge of the airfoil portion and a second end in vertical porixmity to the trailing edge of the airfoil portion, the concave edge being sloped toward sthe root center line radius at a predetermined angle of slope to define an arcuate sloped surface, and having a sloped flat cut-out surface formed at the second end of the platform portion, the flat cut-out surface having the same predetermined angle of slope as the concave edge and sloping towards the X—X axis.

2. A freestanding, mixted tuned taper-twisted steam turbine blade as recited in claim 1, wherein the predetermiend angle of slope is 15°.

3. A freestanding, mixted tuned taper-twisted steam turbine blade as recited in claim 1, wherein the platform portion has a thickness of 0.948 inches (24.07 mm).

4. A freestanding, mixted tuned taper-twisted steam turbine blade as recited in claim 3, wherein the root portion has an upper-most neck and the platform has an overhang relative to the uppermost neck of about 0.246 inches (6.248 mm).

5. A freestanding, mixted tuned taper-twisted steam turbine blade as recited in claim 1, wherein the root portion has an upper-most neck between a bottom of the platform and a bearing surface of an upper-most lug, the upper-most neck having a curved surface formed by a first radius tangent to the bearing surface and a second radius coterminous with the first radius and tangent to the bottom of the platform portion.

6. A freestanding, mixted tuned taper-twisted steam turbine blade as recited in claim 5, wherein the first radius is 0.085 inches (2.159 (mm) and the second radius is 0.180 inches (4.572 (mm).

7. A freestanding, mixted tuned taper-twisted steam turbine blade as recited in claim 6, wherein the first radius has a first center and a second radius has a second center and a line connecting the first and second centers is parallel to the bearing surface of the first lug.

8. A freestanding, mixted tuned taper-twisted steam turbine blade according to claim 5, wherein the first radius has a zero offset to the tangency point of a corresponding steeple radius, so that the tangency points are common to both of the curved surfaces formed by said first and second radii.

9. A row of freestanding, taper-twisted mixed tuned steam turbine blades having an X—X axis parallel to a rotor axis, each blade of the row comprising:

a root portion having a root center line defined by a root center line radius;

a platform portion connected to the root portion; and an airfoil portion connected to the platform portion and having a leading edge, a trailing edge, a convex suction-side surface, a concave pressure-side surface and a profiled tip, the platform portion having a concave edge, a convex edge, a first end in vertical proximity to the leading edge of the airfoil portion and a second end in vertical porixmity to the trailing edge of the airfoil portion, the concave edge being sloped toward sthe root center line radius at a predetermined angle of slope to define an arcuate sloped surface, and having a sloped flat cut-out surface formed at the second end of the platform portion, the flat cut-out surface having the same predetermined angle of slope as the concave edge and sloping towards the X—X axis, wherein the profile tip has a first length for half of the blades of the row and a second length for the other half of the blades of the row, the blades being arranged in the row to alternate profile tip lengths to effect a mixed tuning.

10. A row of freestanding, taper-twisted mixed tuned steam turbine blades as recited in claim 9, wherein teh first length of the prfiled tip is 0.075 inches (1.905 (mm) and the second length of the prifled tip is 0.200 inches to 0.305 inches (5.08 mm to 7.747 mm).

11. A freestanding, mixed tuned taper-twisted steam turbine blade as recited in claim 10, wherein the predetermined angle of slope is 15°.

12. A freestanding, mixed tuned taper-twisted steam turbine blade as recited in claim 11, wherein the platform portion has a thickness of 0.948 inches (24.079 (mm).

13. A freestanding, mixed tuned taper-twisted steam turbine blade as recited in claim 12, wherein the root portion has an upper-most neck and the platform has an overhang relative to the upper-most neck of about 0.246 inches (6.248 (mm).

14. A freestanding, mixed tuned taper-twisted steam turbine blade as recited in claim 9, wherein the root portion has an upper-most neck between a bottom of the platform and a bearing surface of an upper-most lug, the upper-most neck having a curved surface formed by a first radius tangent to the bearings urface and a second radius coterminous with the first radius and tangent to the bottom of the platform portion.

15. A freestanding, mixed tuned taper-twisted steam turbine blade as recited in claim 14, wherein the first radius is 0.085 inches (2.159 (mm) and the second radius is 0.180 inches (4.572 (mm).

16. A freestanding, mixed tuned taper-twisted steam turbine blade according to claim 15, wherein the first radius has a first center and a second radius has a second center and a line connecting the first and second centers is parallel to the bearing surface of the first lug.

17. A freestanding, mixed tuned taper-twisted steam turbine blade according to claim 14, wherein the first radius has a zero offset to the tangency point of a corresponding steeple radius, so that the tangency points are common to both of the curved surfaces formed by said first and second radii.

* * * * *